United States Patent [19]

Aoyama

[11] 4,384,021

[45] May 17, 1983

[54] FABRIC TAPES AND WOVEN FABRICS FOR THE PRODUCTION THEREOF

[75] Inventor: Ryuji Aoyama, Nagoya, Japan

[73] Assignee: Kabushiki Kaisha Aoyama, Nagoya, Japan

[21] Appl. No.: 275,830

[22] Filed: Jun. 22, 1981

[30] Foreign Application Priority Data

Jul. 18, 1980 [JP] Japan ..... 55-102322[U]
Nov. 6, 1980 [JP] Japan ..... 55-158873[U]

[51] Int. Cl.[3] ..... B32B 23/02

[52] U.S. Cl. ..... 428/193; 156/251; 428/192; 428/212; 428/225; 428/257; 428/296

[58] Field of Search ..... 428/192, 193, 212, 220, 428/224, 225, 218, 257, 296; 156/251

[56] References Cited

U.S. PATENT DOCUMENTS 3,316,117 4/1967 Clifford et al. ..... 428/193
3,971,868 7/1976 Murai ..... 428/194
4,148,957 4/1979 Berger et al. ..... 428/193

*Primary Examiner*—James J. Bell
*Attorney, Agent, or Firm*—Robert Scobey

[57] ABSTRACT

A woven fabric tape comprises a main portion and selvage portions provided along both sides of the main portion. The selvage portions are composed of a tissue which is more resistant against fraying than the tissue of the main portion. Each selvage portion of the fabric tape has a fused edge thereby to prevent fraying. A woven fabric suitable for the production of such fabric tapes comprises main portions and selvage forming portions, which are continuously and alternatively woven in a parallel relationship with each other. The selvage forming portions are composed of a tissue which is more resistant against fraying than the tissue of the main portions. The selvage forming portions are made of a thermally fusible material.

20 Claims, 7 Drawing Figures

FABRIC TAPES AND WOVEN FABRICS FOR THE PRODUCTION THEREOF

BACKGROUND OF THE INVENTION

1. Field of the Invention

The present invention relates to fabric tapes and woven fabrics to be used for the production of the fabric tapes. Particularly, it relates to a fabric tape comprising a main portion and selvage portions provided along both sides of the main portion, said main portion and said selvage portions having different woven fabric tissues, and it also relates to a woven fabric from which a plurality of such fabric tapes can be prepared by heat-cutting.

2. Description of the Prior Art

Fabric tapes useful for ornamentation, packing or fabric print labels, are usually made in a form of a tape of a woven fabric having a desired width.

However, it is difficult to produce such fabric tapes efficiently. In order to improve the production of the fabric tapes and to reduce the cost for the production, it has been proposed to firstly weave a wide fabric having a width corresponding to a plurality of fabric tapes and then heat-cut the wide fabric to obtain the plurality of fabric tapes.

It is required that such fabric tapes have a good outer sheen and flexibility. In order to satisfy such requirements, they are usually made of a woven fabric having a satin or velvet tissue. However, such a fabric tissue is very much apt to undergo fraying.

For instance, in the case of a satin tissue, the warps and the wefts are not alternatively woven, but a warp extends underneath 4 to 8 wefts, then over one weft adjacent to said 4 to 8 wefts, and again underneath further 4 to 8 wefts adjacent to said one weft.

When a wide fabric having such a woven fabric tissue is heat-cut to obtain a plurality of fabric tapes and the fused edges produced by the heat-cutting constitute selvages for the prevention of fraying, the strength of the selvages is not adequate. It is likely that fraying occurs at the selvages when a force is applied to the tape or the tape is washed repeatedly or when the tape is subjected to sewing by a sewing machine. Once fraying occurs at the selvages, it tends to be propagated to the main portion of the tape beyond the selvages. As the result, the outer appearance of the tape is degraded.

Further, the conventional wide fabrics are woven to have the same fabric tissue throughout their entire width. Accordingly, the tapes obtained from such a wide fabric by heat-cutting, have the same fabric tissue at both the main portion and the selvage portions. Accordingly, such tapes have a poor outer appearance without any three dimentional features.

Further, in order to increase the strength of such tapes having the same fabric tissue of the above mentioned special type, it is necessary to use fibers having high strength. However, it is difficult to find fibers which have higher strength than the commonly used acetate and which are, at the same time, available at a low price.

SUMMARY OF THE INVENTION

An object of the present invention is to provide a fabric tape comprising a main portion and selvage portions provided along both sides of the main portion, wherein said main portion and selvage portions have different woven fabric tissues, the tissue of the selvage portions being more resistant against fraying than the tissue of the main portion, and each selvage portion has a fused edge.

Another object of the present invention is to provide a fabric tape which has a good overall sheen and flexibility and which is, at the same time, resistant against fraying.

A further object of the present invention is to provide a fabric tape which gives a three dimentional appearance and gorgeousness by the contrast of the different fabric tissues of the main portion and the selvage portions.

A still further object of the present invention is to provide a fabric tape which has an improved overall strength even when fibers such as acetate fibers are used for the main portion.

Another object of the present invention is to provide a woven fabric to be used for the production of fabric tapes, comprising main portions and selvage forming portions which are alternatively and continuously woven in a parallel relationship with each other, said main portions and said selvage forming portions having different woven fabric tissues, the tissue of the selvage forming portions being more resistant against fraying than the tissue of the main portion, and each selvage forming portion is made of a thermally fusible material.

A further object of the present invention is to provide a woven fabric, from which a plurality of fabric tapes can be produced which have fused edges formed by heat-cutting the selvage forming portions thereof.

Thus, the fabric tape of the present invention comprises a main portion and selvage portions provided along both sides of the main portion, said main portion and said selvage portions having different woven fabric tissues, the tissue of each selvage portion being more resistant against fraying than the tissue of the main portion, and each selvage portion having a fused edge.

The woven fabric to be used for the production of fabric tapes according to the present invention, comprises main portions and selvage forming portions which are alternatively and continuously woven in a parallel relationship with each other, said main portions and said selvage forming portions having different woven fabric tissues, the tissue of said selvage forming portions being more resistant against fraying than the tissue of said main portions, and said selvage forming portions being made of a thermally fusible material.

The above objects and other objects of the present invention will become apparent from the following description which is made with reference to the drawings.

DETAILED DESCRIPTION OF THE INVENTION

Figure 1:
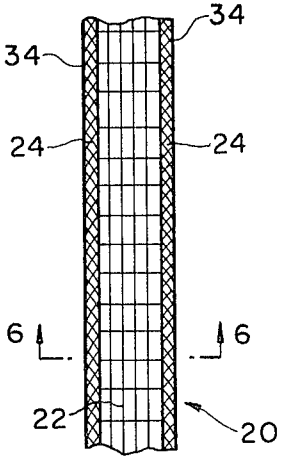
FIG. 1 is a plan view illustrating a part of the fabric tape according to the present invention.

As shown in FIG. 1, a fabric tape 20 of the present invention comprises a longitudinally extending main portion 22 and selvage portions 24 provided along both sides of said main portion 22. The fabric tape 20 is formed to have a desired width of e.g. 2 cm, 3 cm or 5 cm depending upon the particular use of the fabric tape. It is formed as long as possible and cut into a desired length depending upon the particular use.

Figure 2:
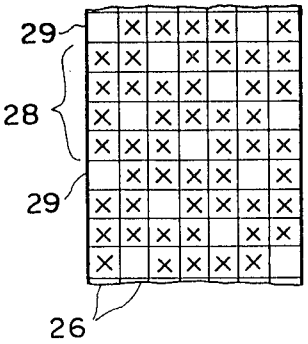
FIG. 2 is an enlarged plan view showing the woven fabric tissue of the main portion of the fabric tape.

In the embodiment shown in FIG. 2, the main portion 22 of the fabric tape 20 has a satin weave. In FIGS. 2 to 5, the symbol x indicates that the warp is located beneath the weft. As shown in FIG. 2, in the case of the satin weave, a warp 26 extends beneath four wefts 28, then over one weft 29 adjacent to the four wefts 28 and again underneath four wefts 28 adjacent to said one weft 29, and this weaving pattern is repeated.

The main portion is woven with use of a regenerated fiber such as acetate or rayon fiber, a polyamide synthetic fiber such as a nylon fiber, a polyester synthetic fiber such as a Tetoron fiber, or a natural fiber such as silk or cotton fiber. Acetate and Tetoron fibers are most preferably used as they have a sheen and flexibility and are available at a low price. The main portion may be woven from the above mentioned fibers to have velvet weave as well as satin weave. In any weave pattern, the warp of the main portion has a thickness of from 50 to 150 deniers and the weft of the main portion has a thickness of from 75 to 250 deniers, and the weft is thicker than the warp. Among the above mentioned fibers, those which are not thermally fusible, are useful only for the warp, and in this case, a thermally fusible fiber is used for the weft.

Figure 3:
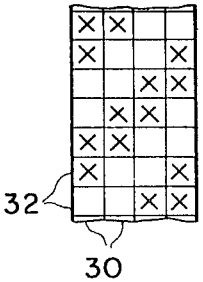
FIGS. 3 to 5 are enlarged plan views showing various woven fabric tissues of the selvage portions of the fabric rapes.

The selvage portions 24 are woven integrally with the main portion 22. As shown in FIG. 3, the selvage portions 24 have a tissue of twill weave. As is apparent from FIG. 3, in the case of the twill weave, a warp 30 is woven with an interval of every two weft 32, and accordingly, the twill weave tissue is more resistant against fraying than the satin weave tissue. Each selvage portion 24 has a fused edge 34, as shown in FIG. 1. Fraying is effectively prevented by the synergistic effects of the edge 34 and the twill weave tissue which is more resistant to fraying than the satin weave tissue. It is preferred that the edge 34 is constituted by the fused portion formed by heat cutting. Accordingly, the selvage portions are woven with a chemical fiber such as an acetate fiber, a polyester synthetic fiber or a polyamide synthetic fiber, which is thermally fusible and has a sheen and which is available at a low price.

Figure 5:
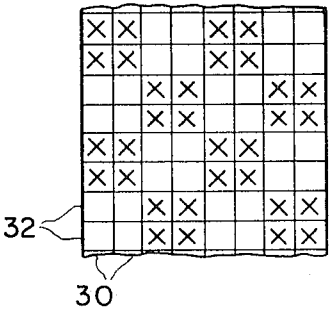
Figure 4:
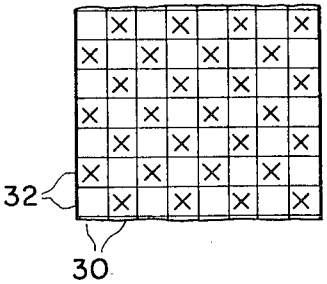

The selvage portions 24 may be woven to have, other than the above mentioned twill weave, plain weave wherein a warp 30 is woven with every adjacent weft 32 as shown in FIG. 4, 2×2 mat weave wherein a set of two warps 30 is woven at an interval of every two wefts 32 as shown in FIG. 5, or 3×3 mat weave (not shown) wherein a set of three warps is woven at an interval of every three wefts. The balanced mat weaves such as said 2×2 mat weave and 3×3 mat weave are modifications of said plan weave. Alternatively, an unbalanced mat weave such as 3×1 mat weave or 4×2 mat weave may be used.

Figure 6:
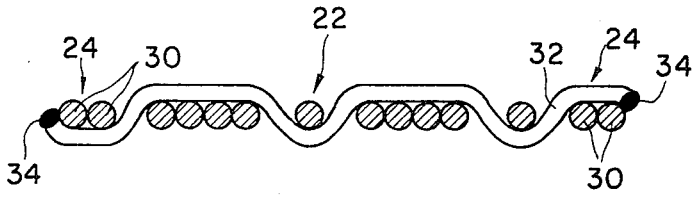
FIG. 6 is an enlarged cross sectional view taken along line 6—6 of FIG. 1.

The transverse cross section, i.e. the cross section along the direction of the weft, of the tape comprising the main portion 22 and selvage portions 24 as shown in FIG. 1, is as shown in FIG. 6. It is apparent from FIG. 6 that the tissue of the selvage portions 24 is denser than the tissue of the main portion 22. As mentioned above, fraying of the selvage portions is effectively prevented by the dense tissue of the selvage portions and the edges provided along the outer sides of the respective selvage portions. Namely, as the tissue of the selvage portions is dense, the opportunity of fusion of the warp with the weft at the time of heat-cutting is high. Besides, the fused edges 34 extend in a longitudinal direction, i.e. along the warp, of the fabric tape, whereby fraying of the selvage portions is effectively prevented. As the selvage portions do not undergo fraying, no fraying of the main portion occurs.

When the fabric tape is cut into a desired length, there is a possibility that fraying occurs at both ends of the main portion of the cut tape. However, for instance, in the case where the cut tape is used for a fabric print label, both ends of the cut fabric tape are folded back and sewed by a sewing machine to eliminate the problem of fraying. Further, even when fraying occurs at both ends of the fabric tape, the adverse effect to the quality of the fabric tape is minimal as compared with the case where fraying occurs along the length of the main portion.

Figure 7:
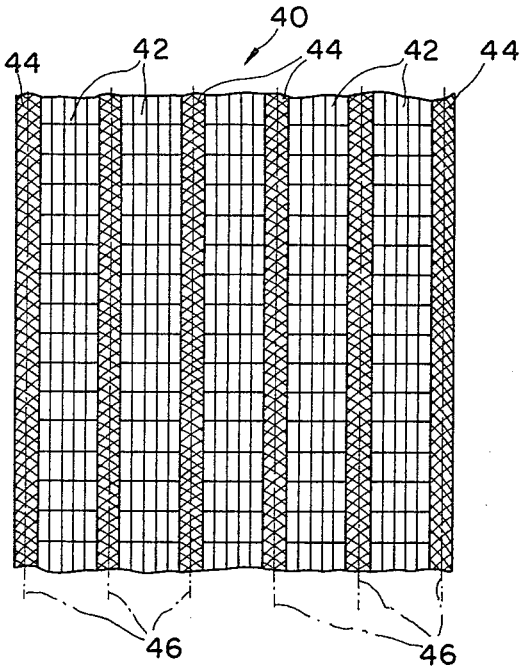
FIG. 7 is a plan view illustrating a part of the woven fabric to be used for the production of fabric tapes according to the present invention.

FIG. 7 shows a woven fabric 40 suitable for the production of the fabric tapes. The woven fabric 40 is woven to have a width comprising a plurality of main portion 42 and a plurality of selvage forming portions 44. This woven fabric is woven in such a manner that the main portions and the selvage forming portions 44 are alternatively and continuously arranged in a parallel relationship with each other in the direction of the weft. In the case where selvage forming portions 44 are provided at both sides of the woven fabric as illustrated, the number of the selvage forming portions is greater than the number of the main portions 42 by one. One of the side selvage forming portions 44 may be omitted, and in this case, the number of the selvage forming portions and the number of the main portions are the same.

The main portions 42 of the woven fabric are composed of the same materials and have the same woven fabric tissues as the main portion 22 of the fabric tape 20 mentioned above. The transverse width of each main portion 42 is equal to the transverse width required for the main portion 22 of the fabric tape 20.

The selvage forming portions 44 are woven from the same thermally fusible fibers and have the same woven fabric tissue as the selvage portions 24 of the above mentioned fabric tape 20 and they have a width twice the transverse width of the selvage portions 24. Fused edges are formed by heat-cutting the selvage forming portions 44 longitudinally along the respective center lines 46 of the selvage forming portions 44. Thus, the fabric tapes are prepared.

What is claimed is:

1. A fabric tape comprising a main portion and selvage portions provided along both sides of said main portion, said main portion and said selvage portions being formed with different weaves therein such that each selvage portion is more resistant against fraying than the main portion, and each selvage portion has a continuous fused edge.

2. The fabric tape as claimed in claim 1, wherein said main portion has a satin weave.

3. The fabric tape as claimed in claim 1, wherein said main portion has a velvet weave.

4. The fabric tape as claimed in claim 2 or 3, wherein said selvage portions have a twill weave.

5. The fabric tape as claimed in claim 2 or 3, wherein said selvage portions have a plain weave.

6. The fabric tape as claimed in claim 2 or 3, wherein said selvage portions have a balanced mat weave as a modification of plain weave.

7. The fabric tape as claimed in claim 2 or 3, wherein said selvage portions have a unbalanced mat weave as a modification of plain weave.

8. The fabric tape as claimed in claim 2 or 3, wherein said main portion is made of an acetate fiber, and said selvage portions are made of a polyamide synthetic fiber.

9. The fabric tape as claimed in claim 2 or 3, wherein said main portion is made of an acetate fiber, and said selvage portions are made of a polyester synthetic fiber.

10. The fabric tape as claimed in claim 1, wherein said main portion has a satin weave of acetate, said satin weave comprising warps of from 50 to 150 deniers and wefts of from 75 to 250 deniers, and said wefts being thicker then said warps.

11. A fabric tape made from a woven fabric which includes main portions and selvage forming portions, which are alternatively and continuously woven in a parallel relationship with each other, the selvage forming portions being made of a thermally fusible material; said fabric tape comprising a main portion, and selvage portions provided along both sides of said main portion and formed by heat-cutting said selvage forming portions longitudinally, said main portion of said fabric tape and each of said selvage portions being formed with different weaves therein such that each selvage portion is more resistant against fraying than the main portion of said fabric tape, and each selvage portion has a fused edge extending continuously and longitudinally by heat-cutting.

12. The fabric tape as claimed in claim 11, wherein said main portions have a satin weave.

13. The fabric tape as claimed in claim 11, wherein said main portions have a velvet weave.

14. The fabric tape as claimed in claim 12 or 13, wherein said selvage forming portions have a twill weave.

15. The fabric tape as claimed in claim 12 or 13, wherein said selvage forming portions have a plain weave.

16. The fabric tape as claimed in claim 12 or 13, wherein said selvage forming portions have a balanced mat weave as a modification of plain weave.

17. The fabric tape as claimed in claim 12 or 13, wherein said selvage forming portions have a unbalanced mat weave as a modification of plain weave.

18. The fabric tape as claimed in claim 12 or 13, wherein said main portions are made of an acetate fiber, and said selvage portions are made of a polyamide synthetic fiber.

19. The fabric tape as claimed in claim 12 or 13, wherein said main portions are made of an acetate fiber, and said selvage portions are made of a polyester synthetic fiber.

20. The fabric tape as claimed in claim 11, wherein said main portions have a satin weave of acetate, said satin weave comprising warps of from 50 to 150 deniers and wefts of from 75 to 250 deniers, and said wefts being thicker than said warps.

* * * * *